US005230478A

United States Patent [19]

Baba et al.

[11] Patent Number: 5,230,478

[45] Date of Patent: Jul. 27, 1993

[54] TRAVERSE METHOD FOR YARNS

[75] Inventors: Kenji Baba, Kyoto; Yutaka Okimura, Takatsuki, both of Japan

[73] Assignee: Murata Kikai Kabushiki Kaisha, Kyoto, Japan

[21] Appl. No.: 525,138

[22] Filed: May 17, 1990

[30] Foreign Application Priority Data

May 19, 1989 [JP] Japan ..... 1-127465

[51] Int. Cl.[5] ..... B65H 54/28; B65H 54/38

[52] U.S. Cl. ..... 242/43 R; 242/18.1

[58] Field of Search ..... 242/43 A, 43 R, 158 B, 242/43.1, 18.1

[56] References Cited

U.S. PATENT DOCUMENTS

| | | | |
|---|---|---|---|
| 3,489,359 | 1/1970 | Richter | 242/43 A |
| 3,933,321 | 1/1976 | Kawauchi et al. | 242/43 R |
| 3,964,724 | 6/1976 | Fisher et al. | 242/43 R |
| 3,981,458 | 9/1976 | Rogers | 242/158 B |
| 4,349,160 | 9/1982 | Niederer | 242/43 R X |
| 4,474,337 | 10/1984 | Schiminski et al. | 242/43 R |
| 4,585,181 | 4/1986 | Schippers et al. | 242/43 R |
| 4,657,195 | 4/1987 | Mori | 242/43 R |
| 4,674,694 | 6/1987 | Hasegawa et al. | 242/43 R |
| 4,767,071 | 8/1988 | Hira | 242/43 R X |
| 5,088,653 | 2/1992 | Baba | 242/43 A X |

FOREIGN PATENT DOCUMENTS

| | | | |
|---|---|---|---|
| 302302 | 10/1971 | U.S.S.R. | 242/43 R |
| 1436441 | 5/1976 | United Kingdom | 242/43 R |

*Primary Examiner*—Daniel P. Stodola
*Assistant Examiner*—Michael R. Mansen
*Attorney, Agent, or Firm*—Spensley Horn Jubas & Lubitz

[57] ABSTRACT

A yarn traverse apparatus method in which two sets of an upstream yarn guide engaged with a first reciprocating spiral groove R-turned within a width of a take up traverse above and below a travel direction of a yarn to always guide the yarn and a downstream yarn guide engaged with a second reciprocating spiral groove R-turned beyond the take-up traverse width to guide the yarn at opposite ends of the take up traverse width are arranged.

11 Claims, 6 Drawing Sheets

TRAVERSE METHOD FOR YARNS

FIELD OF THE INVENTION

The present invention relates to a traverse method for bringing a yarn guide into engagement with a reciprocating spiral groove to reciprocate the yarn.

RELATED ART STATEMENT

A general yarn traverse method for bringing a yarn guide into engagement with the reciprocating spiral groove to reciprocate it is shown in FIG. 6. Normally, a reciprocating spiral groove 2 is formed in the surface of a columnar scroll cam 1. A yarn guide 3 is engaged with the reciprocating spiral groove 3 so that the former reciprocates in a section G. In order to obtain ideal reciprocation of the yarn guide 3, shapes of left and right inverted areas of the yarn guide 3 is desired to be a bended corner as shown. However, if the bended corner is formed, a great inverting force is applied to the yarn guide 3, shortening the life. In view of the above, presently, bends are formed in left and right inverting areas of the reciprocating spiral groove 2 as shown by the letter R in FIG. 6. However, superposition of yarns at opposite ends of the package increases due to the R-bend, and saddle bag or the like occurs, worsening the package shape.

As the means having the left and right inverting areas of the reciprocating spiral groove 2 formed into R-bends and rapidly inverting a yarn, a device shown in FIG. 7 has been proposed (See Japanese Patent Application Laid-Open Publication Nos. 58-135068 and 58-224972). That is, in FIG. 7, a yarn guide 3 is of a rectangular shape, which is engaged with the reciprocating spiral groove 2 and guide rails 4, 4' for lateral reciprocating movement. A left side 3*a* of the yarn guide 3 constitutes a left-ward contact portion of a yarn 5 to guide the latter. Likewise, a right side 3*b* of the yarn guide 3 constitutes a rightward contact of the yarn 5 to guide the latter. The alternate guide of these left and right sides 3*a* and 3*b* strokes the yarn 5. When the yarn guide 3 approaches to the left and right inverting areas, the yarn 5 runs on a yarn release member 6 so that the yarn 5 is released from either contact portion of the left and right sides 3*a* and 3*b*. The yarn 5 is released from the yarn guide 3 and is naturally inverted by tension of the yarn 5. The operation of the yarn guide 3 and the yarn release member 6 will be described in more detail with reference to FIG. 8 (*a*), (*b*), (*c*), (*d*) and (*e*). In FIG. 8 (*a*), the yarn 5 is guided by the left side 3*a* and strokes leftward In FIG. 8 (*b*) in the state immediately before the yarn guide 3 arrives at the R-bend, the yarn 5 runs on the yarn release member 6, and is released from the left side 3*a*. A yarn locus $K_2$ is rapidly inverted at an angle $\theta$ according to tension of yarn 5. In FIG. 8*c*, the yarn guide 3 is positioned at the leftmost end, and the yarn 5 is freely positioned on the right side 3*b* of the yarn guide 3. In FIG. 8 (*d*), the yarn guide 3 passes through the R-bend to run after the yarn 5. In FIG. 8 (*e*), the yarn guide 3 catches up the yarn 5, and the yarn 5 contacts the right side 3*b* to form a yarn locus $K_3$ caused by the yarn guide 3. As described, the yarn loci comprise three sections, a yarn locus $K_1$ in contact with the left side 3*a* of the yarn guide 3, a yarn locus $K_2$ naturally returning by tension of the yarn 5, and a yarn locus $K_3$ in contact with the right side 3*b* of the yarn guide 3. In FIG. 7, R represents a touch roller, Sp a bobbin holder, B a bobbin and P a bundle.

In the yarn traverse method explained in the prior art, the yarn 5 after released from the yarn guide 3 is inverted depending upon the yarn tension or the like, and the yarn guide 3 having passed through the R-bend has caught up to guide the yarn again. As shown in FIG. 8, the yarn locus has the $K_2$ section depending on the yarn tension or the like, but an angle of inclination $\theta$ of the yarn locus $K_2$ and the position of the point P in FIG. 8 where the guide 3 again makes contact to guide the yarn vary depending on the tension of yarn and take-up speed. Accordingly, so-called "depending on yarns" results, posing a problem in that a winding style is not stabilized and an inferior release occurs.

OBJECT AND SUMMARY OF THE INVENTION

The present invention has been accomplished in view of the problems as noted above with respect to prior art. An object of an embodiment of the present invention is to provide a yarn traverse method in which a yarn guide guides a yarn and an inversion of yarn can be made to be acute angle.

For accomplishing the aforesaid object, the present invention provides a traverse method which includes arranging two sets yarn guides which are operably connected to a first reciprocating spiral groove. The yarn guides are traversed within a width of a take up traverse above and below a travel direction of a yarn so as to always guide the yarn. A downstream yarn guide is also provided which is engaged with a second reciprocating spiral groove. The downstream guide is traversed beyond the take-up traverse width to guide the yarn at opposite ends of the take up traverse width.

When at least two of the upstream yarn guides enters a predetermined portion of the spiral groove within the take up traverse width, the downstream yarn guide catches the yarn to bend the yarn from the upstream yarn guide to guide the yarn to the take up traverse width.

When the yarn reaches the take up traverse width, the yarn is released from the downstream yarn guide to return the yarn to a position with one of the upstream yarn guides by yarn tension.

DETAILED DESCRIPTION OF PREFERRED EMBODIMENTS

Embodiments of the present invention will be described hereinafter with reference to the drawings.

Figure 1:
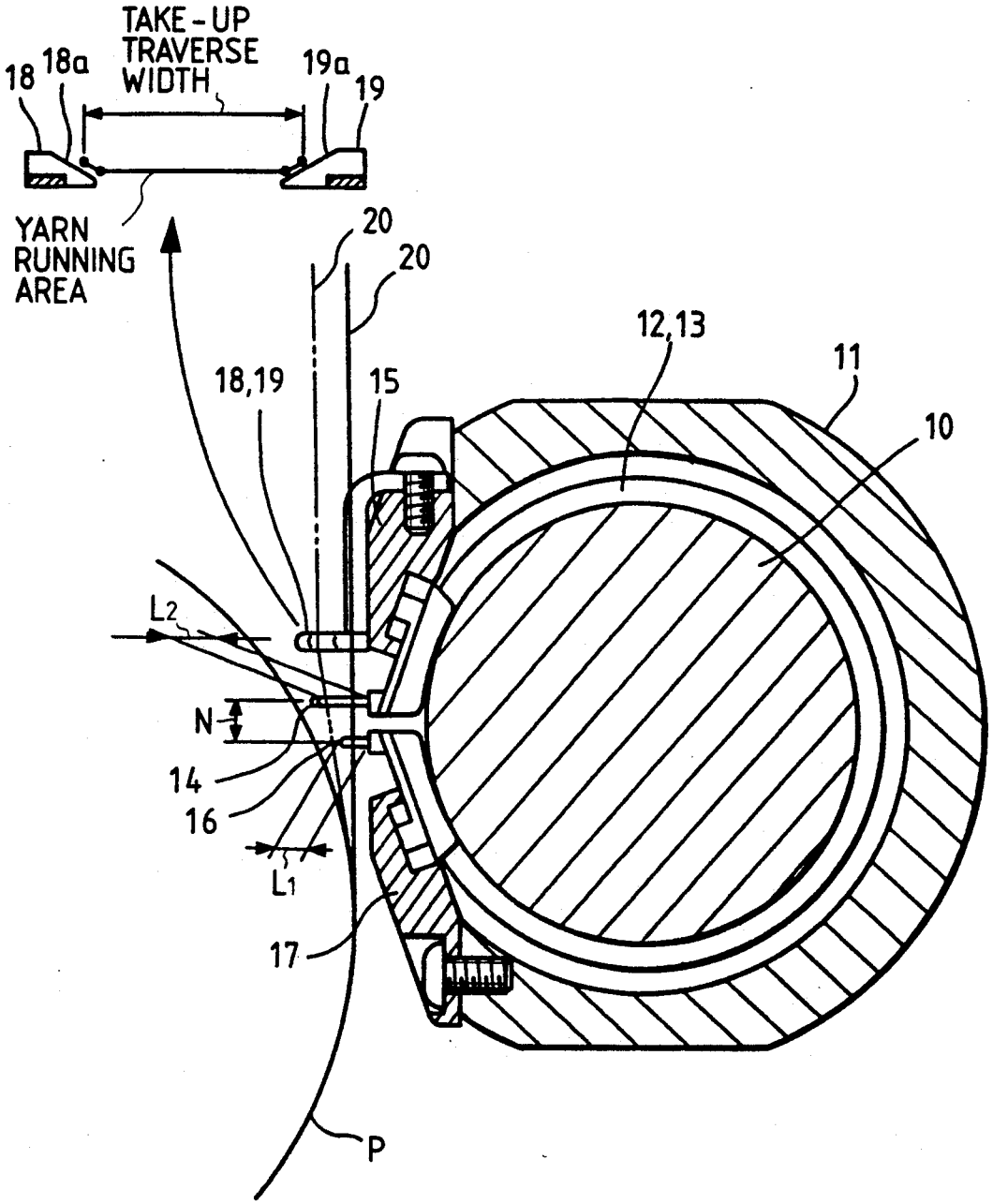
FIG. 1 is a sectional view of a traverse device.
Figure 2:
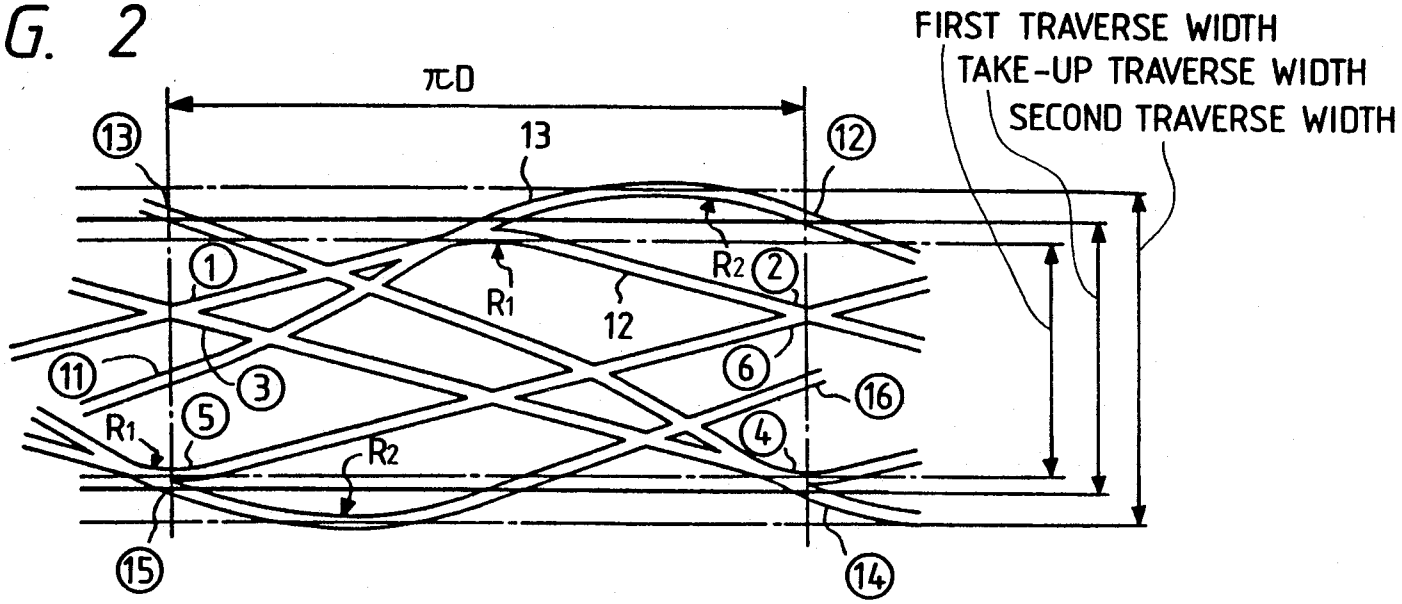
FIG. 2 is a developed view of a scroll cam.
Figure 4B:
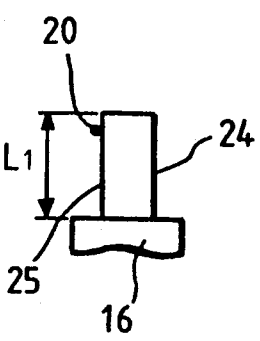
FIGS. 4*a* and 4*b* are views showing an upstream yarn guide and a downstream yarn guide, respectively.
Figure 4A:
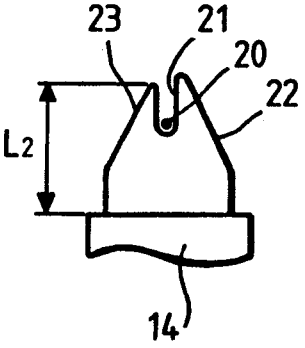
Figure 3:
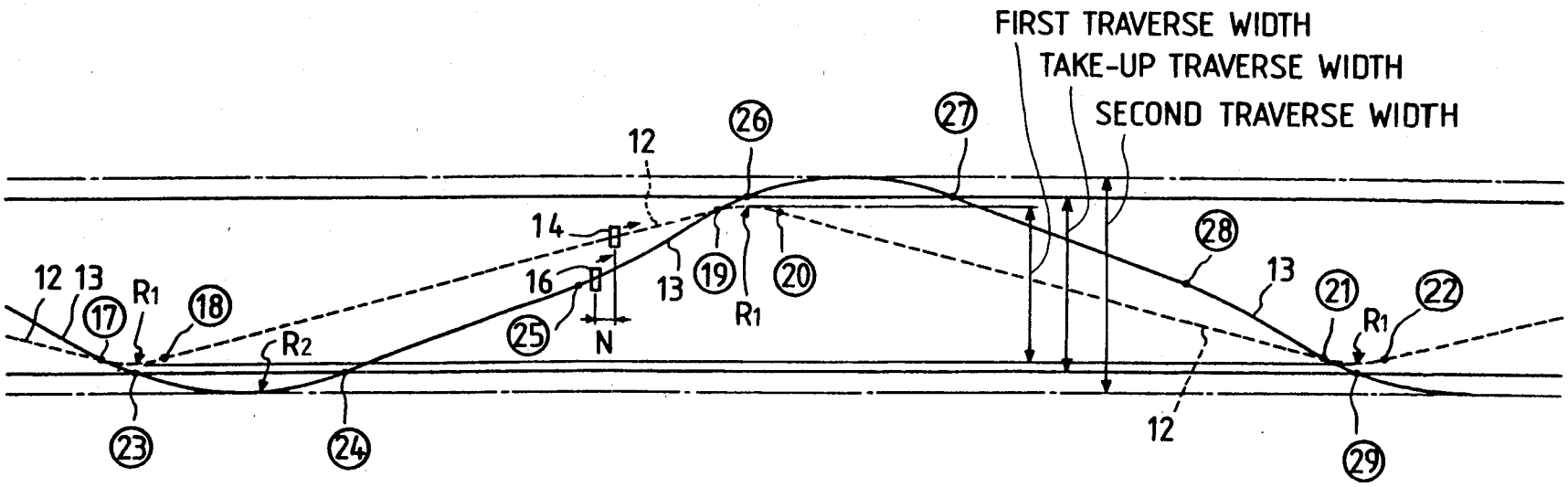
FIG. 3 is a transfer developed view of two sets of reciprocating spiral grooves.
Figure 5:
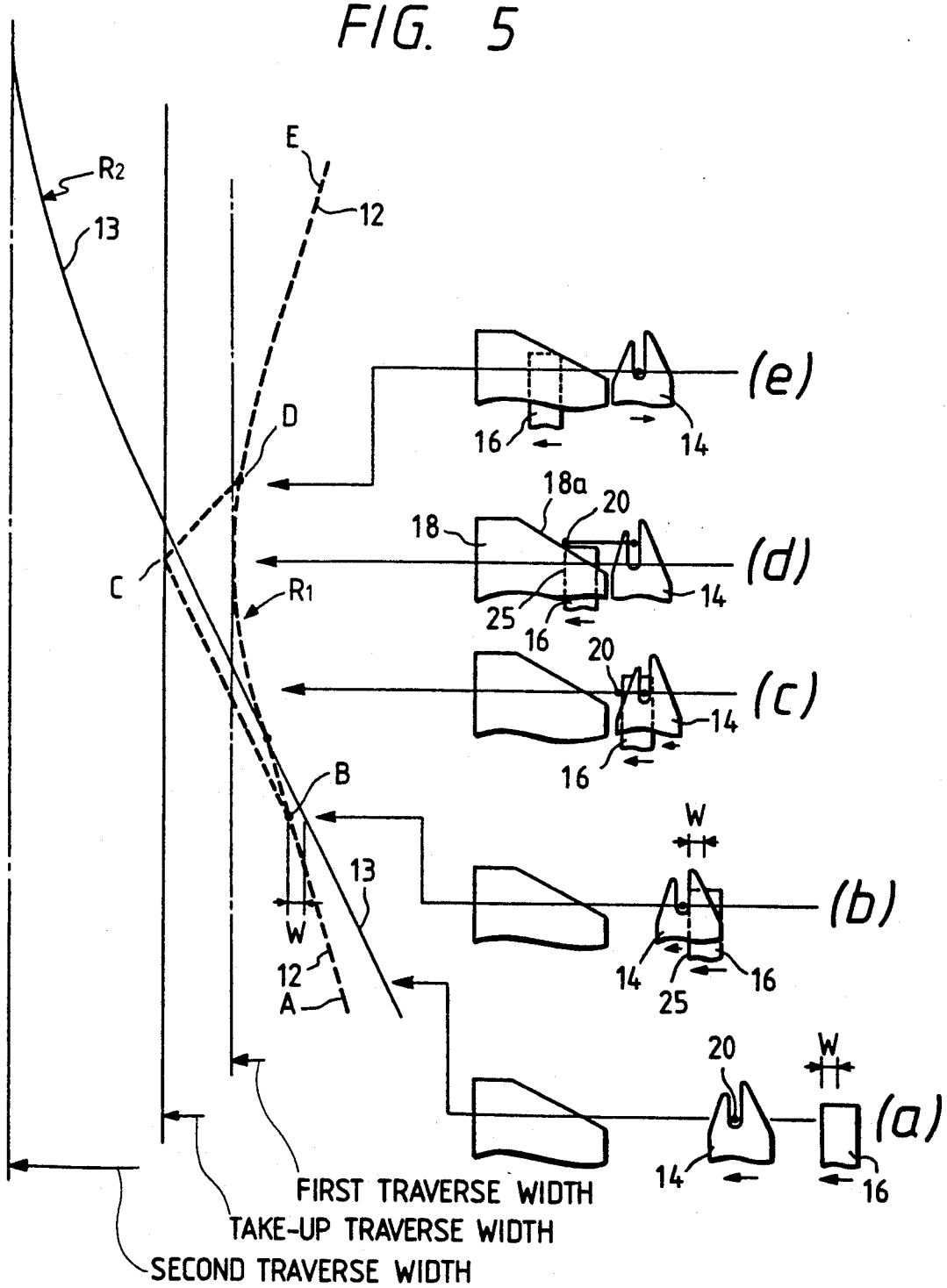
FIG. 5 is an operation view for the traverse method of the present invention.
Figure 6:
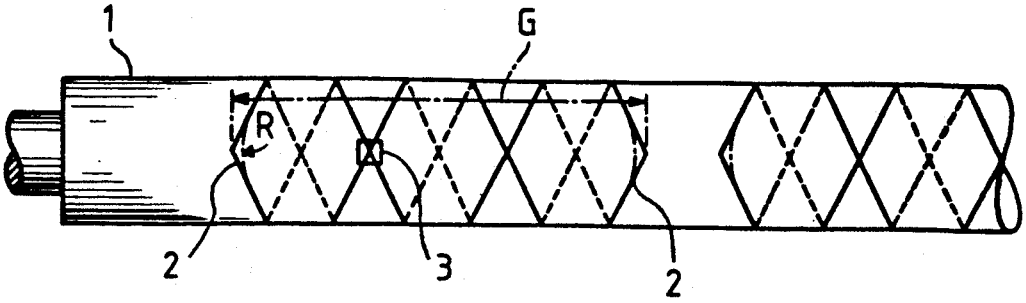
FIG. 6 is a front view showing a conventional scroll cam.
Figure 7:
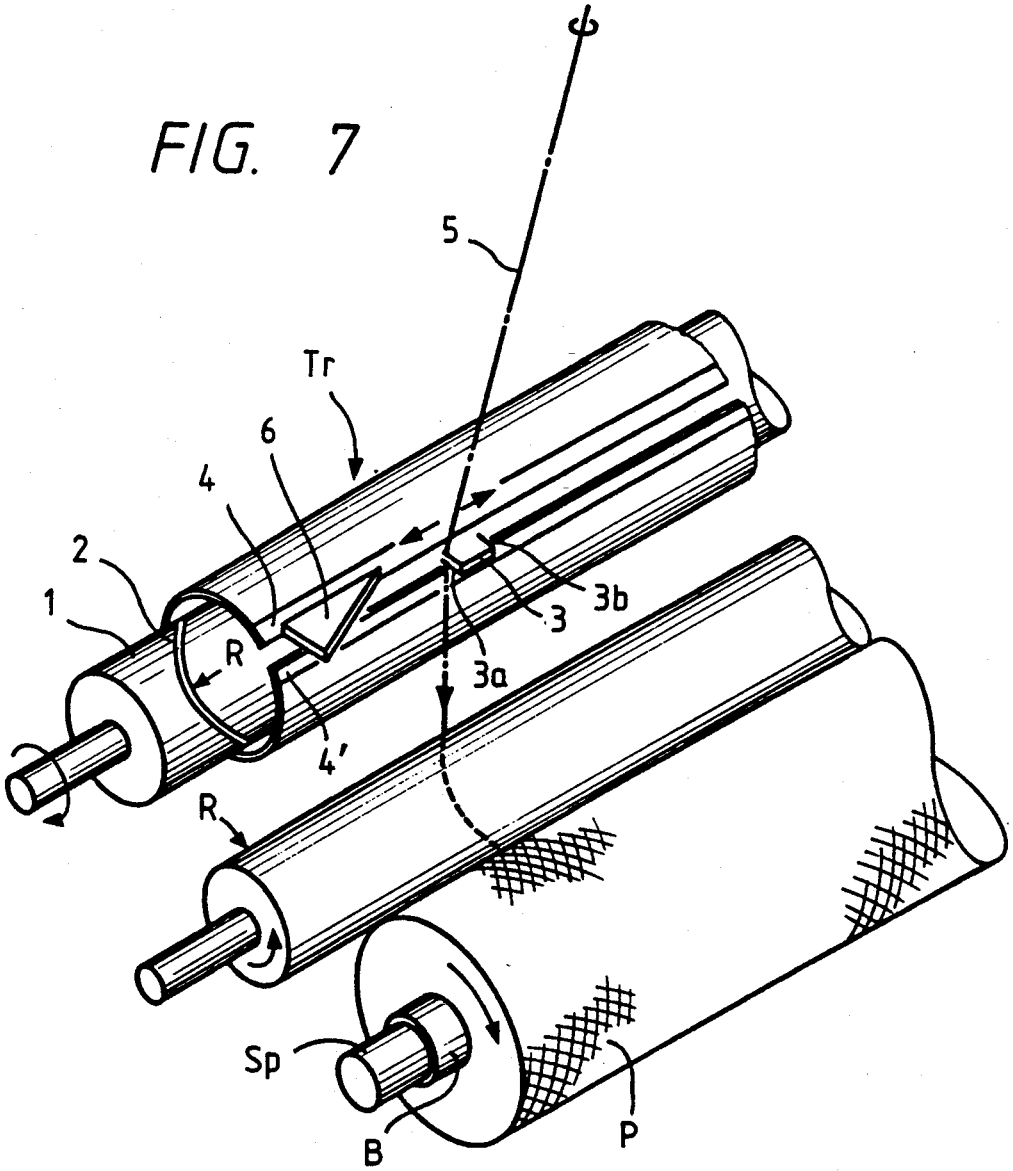
FIG. 7 is a perspective view of a traverse device used for the conventional traverse method.
Figure 8:
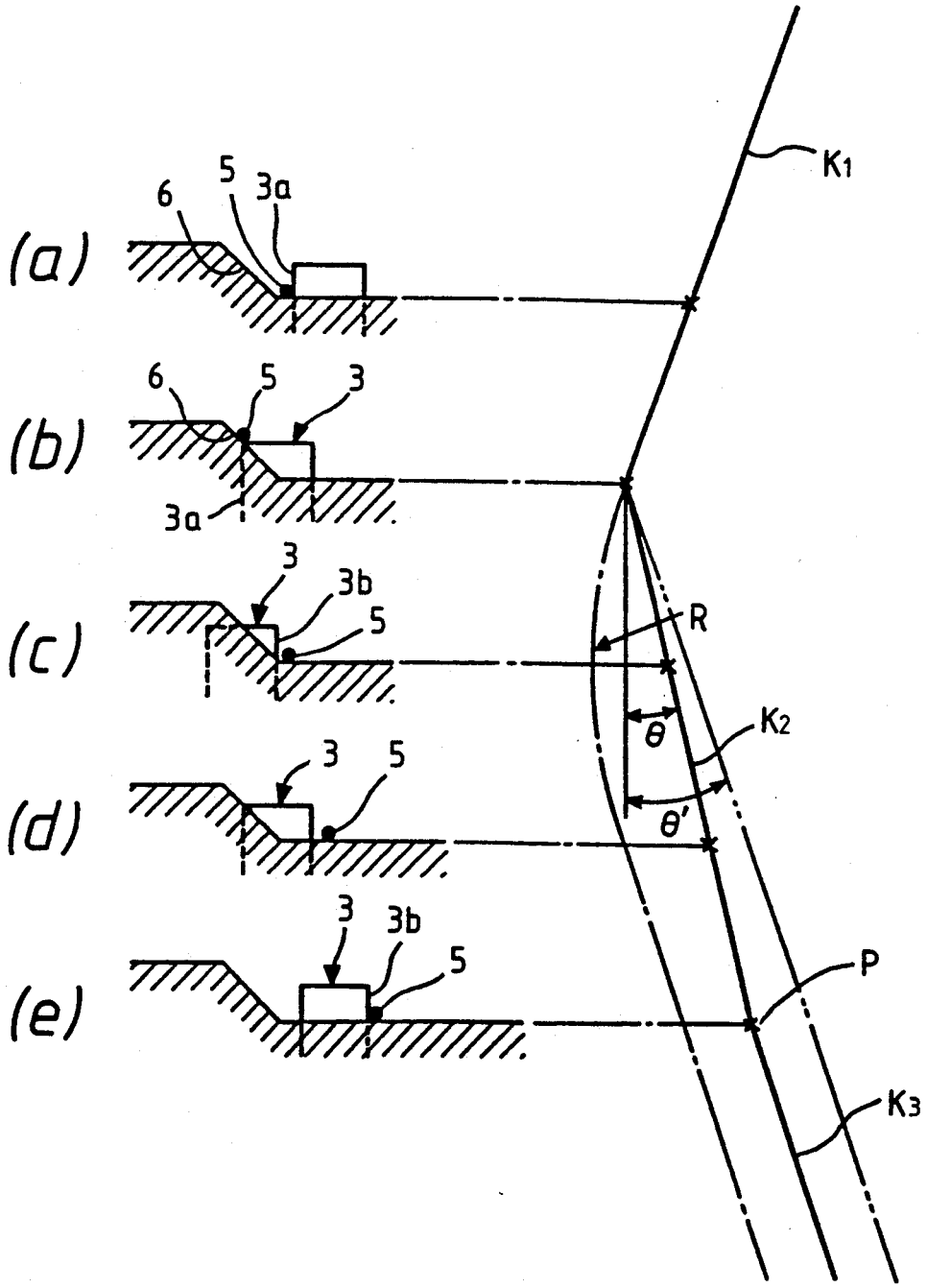
FIG. 8 is an operation view of the conventional traverse method.

FIG. 1 is a sectional view of a traverse device, FIG. 2 is a developed view of a scroll cam, FIG. 3 is a transfer developed view of two sets of reciprocating spiral grooves, FIGS. 4*a* and 4*b* are views showing an upstream yarn guide and a downstream yarn guide, respectively, and FIG. 5 is a traverse method of the present invention.

First, a traverse device most suitable for carrying out the traverse method will be described referring to FIGS. 1 to 4, and next, the traverse method of the present invention will be described referring to FIG. 5. While for convenience' sake of explanation, a description will be made of the traverse device shown in FIG. 1 in which two sets of yarn guides are provided on a single scroll cam, it is to be noted that even a device in which two scroll cams having a single yarn guide are opposedly arranged, this traverse method can be carried out.

In FIG. 1, a scroll cam 10 is rotatably supported within a cam drum 11. In the surface of the scroll cam 10 are formed a first reciprocating spiral groove 12 and a second reciprocating spiral groove 13 shown in FIG. 2. An upper guide rail 15 for axially guiding an upstream yarn guide 14 engaged with the first reciprocating spiral groove 12 and a lower guide rail 17 for axially guiding a downstream yarn guide 16 engaged with the second reciprocating spiral groove 13 are provided on the cam drum 11, the upstream and downstream yarn guides 14 and 16 being traversed in a lateral direction while maintaining a positional relation of a spacing N with respect to the travelling direction of a yarn 20. Yarn release guides 18 and 19 are spaced from the upstream and downstream yarn guides 14 and 16. The yarn release guides 18 and 19 are arranged symmetrically to left and right of a take up traverse width of yarn as shown by drawn lines to alter a yarn running area at inclined sides 18*a* and 19*a*. In particularly, the release guides release the yarn from the down stream yarn guide 16. The length $L_1$ of a guide portion of the downstream yarn guide 16 is shorter than a length $L_2$ of a guide portion of the upstream yarn guide 14, and even if the downstream yarn guide 16 releases the yarn 20 when the yarn release guides 18 and 19 are operated as in the yarn 20 indicated by the dash-dotted contour lines, the upstream yarn guide 14 remains holding the yarn 20.

Next, the construction of the first and second reciprocating spiral grooves 12 and 13 will be described with reference to FIGS. 2 and 3. FIG. 2 shows an arrangement wherein in the surface of a single scroll cam 10 are formed the first reciprocating spiral groove 12 for making a designated $R_1$ turn within the take up traverse width and the second reciprocating spiral groove 13 for making a turn designated $R_2$ beyond the take up traverse width, which are developed at $\pi D$. The first reciprocating spiral groove 12 forms an infinite track while making the $R_1$ turn at opposite ends, a→b→c→d→e→f→g, and the second reciprocating spiral groove 13 forms an infinite track while making the $R_2$ turn at opposite ends, g→i→j→k→m→g. FIG. 3 shows a transfer development of the first reciprocating spiral groove 12 and the second reciprocating spiral groove 13 for clarifying the positional relation between the first and second reciprocating grooves 12 and 13. In FIG. 3, the first reciprocating spiral groove 12 provides for turns $R_1$ in the area of intersections m, q, s with the second reciprocating spiral groove 13. That is, the n→p→q→r and s→t are the $R_1$ turn, and other p→q and r→s are linear, and the upstream yarn guide 14 engaged with the linear portion takes a share in the central portion of a bundle. In the second reciprocating spiral groove 13, portions u→v and x→y beyond the take up traverse width are the $R_2$ turn, and the remainder of the traverse is composed of gentle straight lines of v→w and y→z and sharp straight lines of w→x and z→h. The slope is changed from the gentle straight line to the sharp straight line because passing points of n, q and s are set to fixed positions. Particularly, at n→4, u→x and s→h, the downstream yarn guide 16 passes the upstream yarn guide 14 to guide the yarn to the take up traverse width, and when reaching the take up traverse width, the yarn is released to take a share in both ends of the bundle.

Next, the construction and operation of the yarn guides 14 and 16 at upstream and downstream will be described. In FIG. 4*a*, the upstream yarn guide 14 is of a mountainous shape having a slit 21 formed in a central portion thereof to receive a yarn 20, a right oblique side 22 being higher than a left oblique side 23. Accordingly, the yarn 20 is kept held as long as the yarn 20 is present within the slit 21 located deeper than the left oblique side 23. The downstream yarn guide 16 is of a rectangular projection, a right side 24 or a left side 25 alternately guiding the yarn 20. A height $L_2$ of the left oblique side 23 of the upstream yarn guide 14 is higher than a height $L_1$ of the downstream yarn guide 15, and even if the yarn 20 is released from the downstream yarn guide 16 by the yarn release guides 18 and 19 shown in FIG. 1, the upstream yarn guide 14 remains holding the yarn 20. Accordingly, between n→u, q→x and s→u, (FIG. 3), the upstream yarn guide 14 remains holding the yarn 20, and the downstream yarn guide 16 guides the yarn 20 to the take up traverse width, and when reaching the take up traverse width, the yarn 20 is released only from the downstream yarn guide 16.

Next, the traverse method of the present invention using the traverse device constructed as described above will be described with reference to FIG. 5. While FIG. .5 shows one of the take up traverse width for purposes of explanation, it is to be noted that the same is true for the other.

In FIG. 5 (*a*), while the upstream yarn guide 14 goes ahead of the downstream yarn guide 16, the upstream yarn guide 14 guides the yarn 20, and the yarn locus assumes an A-B straight line.

Next, as shown in FIG. 5 (*b*), the downstream yarn guide 16 catches up at a point B, and the left side 25 of the downstream yarn guide 16 closer to the bundle guides the yarn 20 to determine the yarn locus. Accordingly, the yarn locus assumes a parallel straight line B-C spaced by half W of the width of the downstream yarn guide 16 from the second reciprocating spiral groove 3. At that time, as shown in FIG. 5 (*c*), the yarn 20 remains held by the upstream yarn guide 14, and therefore, the yarn 20 is bended at a distance N (see FIG. 1) extending from the upstream yarn guide 14 to the downstream yarn guide 16. During that period, the upstream yarn guide 14 turns due to turn $R_1$.

Next, as shown in FIG. 5 (*d*), the yarn 20 runs on the inclined side 18*a* of the yarn release guide 18, and the yarn 20 is released from the left side 25 of the downstream guide 16. Accordingly, the bend of the yarn 20 between the upstream yarn guide 14 and the downstream yarn guide 16 is rapidly overcome by the yarn tension, and the yarn locus assumes a straight line C-D. Then, the downstream yarn guide 16 enters the turn $R_2$.

Next, as shown in FIG. 5 (*e*), the yarn 20 is again guided while being held on the upstream yarn guide 14, and the yarn locus assumes D-E ($R_2$ turn sometimes partly remains). The yarn 20 remains held by the upstream yarn guide 14, and the yarn locus traces A-B-C-D-E to assume an acute-angled turn.

Being constructed as described above, the present invention has the following effects.

When the upstream yarn guide enters the R turn, the downstream yarn guide causes the yarn from the upstream yarn guide to be bended to guide the yarn to the take up traverse width, and then when reaching the take up traverse width, the yarn is released from the downstream yarn guide to return it to the position of the upstream yarn guide by yarn tension. In this manner, an acute-angled turn is effected alloting roles such that the upstream yarn guide takes a share in the central portion of the bundle and the downstream yarn guide in the both ends of the bundle. Moreover, the upstream yarn guide always holds the yarn to almost eliminate a variation of the yarn locus after release. Therefore, no "acute-angled turn depending on yarn" occurs and the locus of yarn is constant. The style of winding is stabilized to prevent occurrence of inferior release.

What is claimed is:

1. A traverse apparatus for guiding yarn along a path, the path defining an upstream portion and a downstream portion, the apparatus comprising:

a scroll can which is rotatably supported within a cam drum and around which a first reciprocating spiral groove and a second reciprocating spiral groove are formed;

an upstream yarn guide engaged with the first reciprocating spiral groove and reciprocally traversing the scroll cam through a first traverse width;

a downstream yarn guide engaged with the second reciprocating spiral groove and reciprocally traversing the scroll cam through a second traverse width;

an upper guide rail and a lower guide rail for guiding the upstream yarn guide and the downstream yarn guide, respectively; and a plurality of yarn release guides which are spaced from the upstream and downstream yarn guides, wherein the upstream and downstream yarn guides are traversed while maintaining a predetermined spacing between the upstream and downstream yarn guides with respect to the path and wherein the upstream yarn guide maintains uninterrupted contact with the yarn during a revolution of the scroll cam.

2. The traverse apparatus as claimed in claim 1, wherein the first reciprocating spiral groove is formed so as to define the first traverse width and the second reciprocating spiral groove is formed so as to define the second traverse width, the second traverse width being greater than the first traverse width.

3. The traverse apparatus as claimed in claim 2, wherein each of the upstream and downstream yarn guides extend a first and second predetermined distance, respectively, from a surface of the scroll cam, the second predetermined distance being shorter than the first predetermined distance.

4. The traverse apparatus as claimed in claim 3, wherein the upstream yarn guide includes at least two oblique side portions and a slit formed in a central portion between the two oblique side portions to receive the yarn.

5. The traverse apparatus as claimed in claim 4, wherein one of the two oblique side portions is formed to be higher than the other.

6. The traverse apparatus as claimed in claim 3, wherein the downstream yarn guide is formed as a rectangular projection from the surface of the scroll cam.

7. The traverse apparatus according to claim 2, wherein the upstream yarn guide guides the yarn through the first traverse width and the downstream yarn guide movably contacts the yarn while the first yarn guide guides the yarn through the first traverse width to extend the traverse of the yarn beyond the first traverse width, wherein at least one of the plurality of yarn releasing guides releases the yarn from contact with the downstream traverse guide at a predetermined point disposed between an end point of the first traverse width and an end point of the second traverse width.

8. A method for traversing a yarn comprising the steps of:

providing a scroll cam having first and second spiral grooves, providing first and second yarn guides slidably disposed within the respective first and second reciprocating spiral grooves of the scroll cam, the first and second yarn guides being arranged such that the first and second yarn guides are displaced a predetermined distance with respect to a direction of travel of the yarn, reciprocally moving the first yarn guide through a first traverse width having first and second end points, reciprocally moving the second yarn guide through a second traverse width having third and fourth end points, the second traverse width being greater than the first traverse width, guiding the yarn through the first traverse width with the first yarn guide, movably contacting the yarn with the second yarn guide as the second yarn guide is reciprocally moved through the second traverse width so as to extend a traverse width of the yarn, releasing the yarn from contact with the second yarn guide at a predetermined point before the second yarn guide reaches one of the third and fourth end points of the second traverse width.

9. A method according to claim 8, wherein the step of contacting the yarn includes contacting the yarn such that the first yarn guide maintains contact with the yarn while the second yarn guide contacts the yarn.

10. A method according to claim 9, wherein the first yarn guide always maintains contact with the yarn.

11. The method of claim 8, wherein the second traverse width is substantially greater than a take-up traverse width and the first traverse width is substantially less than the take-up traverse width.

* * * * *